United States Patent [19]

Okada

[11] Patent Number: 5,034,585

[45] Date of Patent: Jul. 23, 1991

[54] SOLDER ATTACHABLE PUSH BUTTON SWITCH

[75] Inventor: Mitsuhiro Okada, Iwaki, Japan

[73] Assignee: Alps Electric Co., Ltd., Tokyo, Japan

[21] Appl. No.: 527,664

[22] Filed: May 21, 1990

Related U.S. Application Data

[63] Continuation of Ser. No. 265,173, Oct. 27, 1988, abandoned.

[30] Foreign Application Priority Data

Dec. 8, 1987 [JP] Japan ..... 62-185969

[51] Int. Cl.[5] ..... H01H 9/02

[52] U.S. Cl. ..... 200/293; 200/332.1

[58] Field of Search ..... 200/292, 294, 332.1, 200/406, 533, 535, 293

[56] References Cited

U.S. PATENT DOCUMENTS 4,383,155 5/1983 Tenner ..... 200/292 X 4,429,201 1/1984 Dekkers et al. ..... 200/535 X

*Primary Examiner*—Renee S. Luebke

*Attorney, Agent, or Firm*—Guy W. Shoup; David W. Heid

[57] ABSTRACT

A switch is disclosed having a switch element comprised of a laminated structure including a fixed contact member and a movable contact member spaced apart with a spacer interposed therebetween. The fixed contact member and the movable contact member have respective terminals extending out of a case body of the switch and are adapted to be soldered to a soldering land of a printed circuit board. The switch is improved by providing a projection between the switch element and the case body for creating a space. The space created by the projection prevents solder flux from moving by capillary action into the contact portions of the switch element.

4 Claims, 3 Drawing Sheets

SOLDER ATTACHABLE PUSH BUTTON SWITCH

This application is a continuation of application Ser. No. 07/265,173, filed 10/27/88, now abandoned.

BACKGROUND OF THE INVENTION

The present invention relates to a switch for use with various input devices in a personal computer and a word processor, for example, and more particularly to a switch of a type such that a terminal of a fixed contact member and a terminal of a movable contact member in the switch are projected from a lower surface of a case body, and they are soldered to a soldering land of a printed circuit board.

FIGS. 2 to 5 show a prior art push button switch, wherein FIG. 2 is a vertical sectional view of the push button switch; FIG. 3 is a bottom plan view of the push button switch with its lower case removed; FIG. 4 is an exploded perspective view of a switch element to be installed in the push button switch; and FIG. 5 is a vertical sectional view of the push button switch mounted on the printed circuit board.

Referring to FIGS. 2 and 3, a lower case 1 and an upper case 2 are assembled with each other by snap coupling means (not shown). The upper case 2 is formed at its upper central position with an insert hole 2*a* for inserting therethrough a stem 3 constituting a part of an operating member. A spring 5 is interposed between the stem 3 and a bottom inner surface of the lower case 1. A key top 4 as the operating member is fixedly engaged with an upper portion of the stem 3.

A switch element 6 is installed at a side portion of an inner space defined by the lower case 1 and the upper case 2. As shown in FIG. 3, the switch element 6 is supported to the upper case 2 in such a manner as to be prevented from moving toward the stem 3 by a pair of inward projections 2*b* of the upper case 2. A pusher spring 11 is fixedly engaged with an upper portion of the switch element 6. The pusher spring 11 has a bent portion 11*a*, an elongated portion 11*b*, and an operating projection 11*c*. The elongated portion 11*b* extends to a lower side of the stem 3, and is formed at its lower end with a forked portion adapted to enter a reciprocating area of the stem 3.

A leaf spring 12 is provided in the inner space of the case body on the opposite side of the switch element 6 with respect to the stem 3. The leaf spring 12 has an upright portion 12*a* extending along a side wall surface of the upper case 2 and an elongated portion 12*b* extending to the lower end of the stem 3. A lower end of the elongated portion 12*b* constitutes a click projection 12*c* abutting against the lower portion of the stem 3 and adapted to retractably enter the reciprocating area of the stem 3. The upright portion 12*a* is sandwiched between the side wall of the upper case 2 and a retainer plate 13. The retainer plate 13 is supported to the upper case 2 in such a manner as to be prevented from moving toward the stem 3 by a pair of inward projections 2*c* of the upper case 2.

As shown in FIG. 4, the switch element 6 consists of an operating member 7 formed of synthetic resin, a movable contact member 8 formed of metal, a spacer 9 formed of synthetic resin, and a fixed contact member 10 formed of metal. The operating member 7 is formed with a pushing portion 7*a*. The movable contact member 8 consists of a frame 8*a*, a metal thin plate 8*b* supported to the frame 8*a* and a terminal 8*d* extending downwardly from the frame 8*a*. The spacer 9 is formed with a circular central opening 9*a*. The fixed contact member 10 has a fixed contact 10*a* exposed through the opening 9*a* of the spacer 9 to the metal thin plate 8*b* of the movable contact member 8 and also has a terminal 10*c* extending downwardly from a lower end of the fixed contact member 10. The movable contact member 8, the spacer 9 and the fixed contact member 10 are formed at their peripheral portions with through-holes 8*c*, 9*b* and 10*b*, respectively, which are arranged coaxially. The operating member 7 is formed at its rear surface with a pair of projections (not shown) to be inserted through the through-holes 8*c*, 9*b* and 10*b* and be caulked at their ends. Thus the components of the switch element 6, that is, the operating member 7, the movable contact member 8, the spacer 9 and the fixed contact member 10 are laminated together.

In operation, when the key top 4 is in an undepressed position as shown in FIG. 2, the stem 3 is disposed at an uppermost position in receipt of a return biasing force of the spring 5 and return biasing forces of the pusher spring 11 and the leaf spring 12. Under the condition, this operating projection 11*c* of the pusher spring 11 does not push the pushing portion 7*a* of the operating member 7, resulting in separation of the metal thin plate 8*b* of the movable contact member 8 from the fixed contact 10*a* of the fixed contact member 10. Thus, the switch is maintained in an off state.

When the key top 4 is depressed, the stem 3 is lowered against the biasing force of the spring 5 to retract the click projection 12*c* of the leaf spring 12 from the reciprocation area of the stem 3 and thereby providing 9 click feeling. At the same time, the pusher spring 11 is also retracted from the reciprocation area of the stem 3 by the lowering motion of the stem 3. As a result, the pushing portion 7*a* of the operating member 7 is pushed by the operating projection 11*c* of the pusher spring 11 to displace the metal thin plate 8*b* of the movable contact member 8 so as to bring the same into contact with the fixed contact 10*a* of the fixed contact member 10. Thus, the switch is turned on.

When the depression force applied to the key top 4 is removed, the stem 3 is returned to the uppermost position as shown in FIG. 2. Accordingly, the pushing force of the operating projection 11*c* against the pushing portion 7*a* is removed to thereby cause the metal thin plate 8*b* to separate from the fixed contact 10*a*. Thus, the switch is turned off again.

As shown in FIG. 5, the push button switch as mentioned above is mounted on a printed circuit board 14 by soldering the terminal 8*d* of the movable contact member 8 and the terminal 10*c* of the fixed contact member 10 projecting from the lower case 1, to the soldering lands 14*a* of the printed circuit board 14 by auto-dipping. In soldering the terminals 8*d* and 10*c* to the soldering lands 14*a*, a flux is applied to the soldering lands 14*a* and the terminals 8*d* and 10*c* for the purpose of improving the solderability. However, since the flux has a good wettability to a metal surface, it tends to enter the inside of the lower case 1 along the surfaces of the terminals 8*d* and 10*c*. Then, the flux is moved to the switch element of a laminated structure, namely, the frame 8*a* or the fixed contact member 10 contacting the bottom inner surface of the lower case 1, and is finally deposited onto the metal thin plate (movable contact) 8*b* or the fixed contact 10*a*. As the flux is an electrically insulating material, the deposition of the flux to the contact portion causes imperfect electrical contact.

To prevent the entry of the flux to the contact portion, an adhesive is applied to a gap between the lower case 1 and the terminals 8*d* and 10*c*. However, the additional step of applying the adhesive causes an increase in cost.

SUMMARY OF THE INVENTION

Accordingly, it is an object of the present invention to provide a switch having a construction which prevents the entry of solder flux into the contact portion of the switch element.

It is another object of the present invention to provide a switch which ensures a high reliability of electrical contact at low cost.

According to the present invention, there is provided in a switch having a switch element of a laminated structure such that a fixed contact member and a movable contact member are laminated with a spacer interposed therebetween, said fixed contact member and said movable contact member having respective terminals extending out of a case body of said switch and adapted to be soldered to a soldering land of a printed circuit board; the improvement comprising a projection provided in a space defined between said switch element and said case body.

In soldering the terminals of the movable contact member and the fixed contact member to the soldering land by auto-dipping, the flux enters the inside of the case body along the surfaces of the terminals. However, since a projection is provided between the switch element and the case body in the present invention the flux is prevented from entering the switch element spaced from the bottom inner surface of the case body. Accordingly, the flux is not deposited to the contact portion of the switch element. The projection may be integrally formed with the switch element or the lower case. In the present invention, it is unnecessary to use an adhesive as in the prior art, thereby reducing the costs.

Other objects and features of the invention will be more fully understood from the following detailed description and appended claims when taken with the accompanying drawings.

BRIEF DESCRIPTION OF THE DRAWINGS

FIG. 6 is a vertical sectional view of the push button switch in another embodiment of the present invention mounted on a printed circuit board;

FIG. 7 is a vertical sectional view of the push button switch in still another embodiment of the present invention mounted on a printed circuit board;

DETAILED DESCRIPTION OF THE PREFERRED EMBODIMENT

There will now be described a preferred embodiment of the present invention with reference to the drawings.

Figure 1:
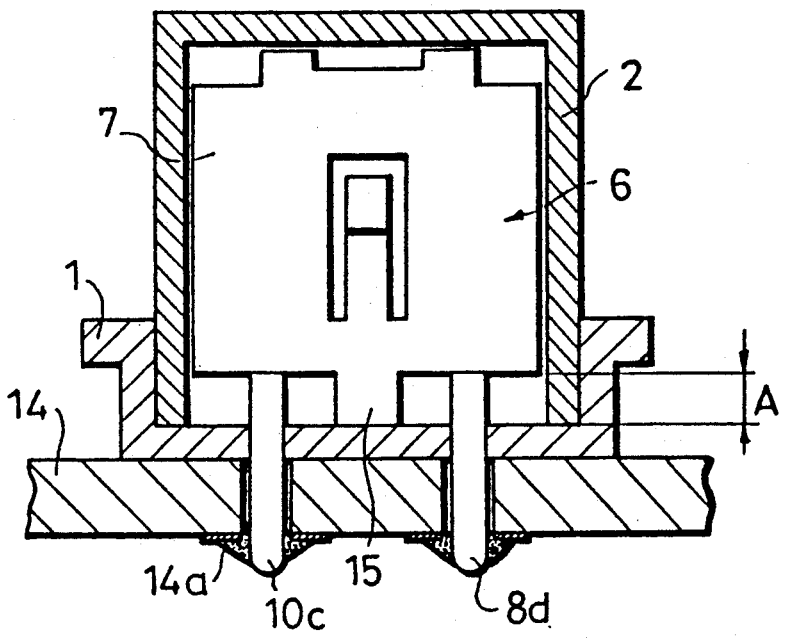
FIG. 1 is a vertical sectional view of the push button switch in a preferred embodiment of the present invention mounted on the printed circuit board.
Figure 5:
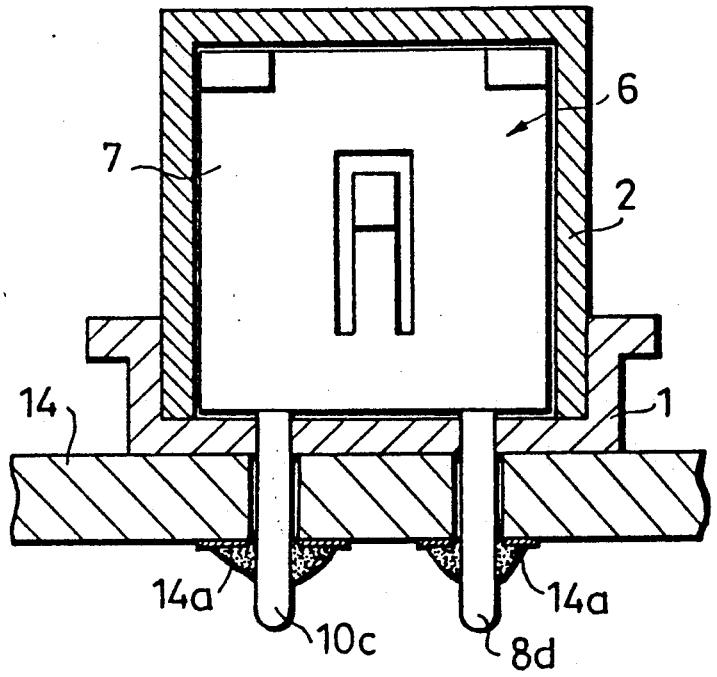
Fig. 5 PRIOR ART
FIG. 5 is a vertical sectional view of the push button switch shown in FIG. 2 mounted on the printed circuit board.
Figure 2:
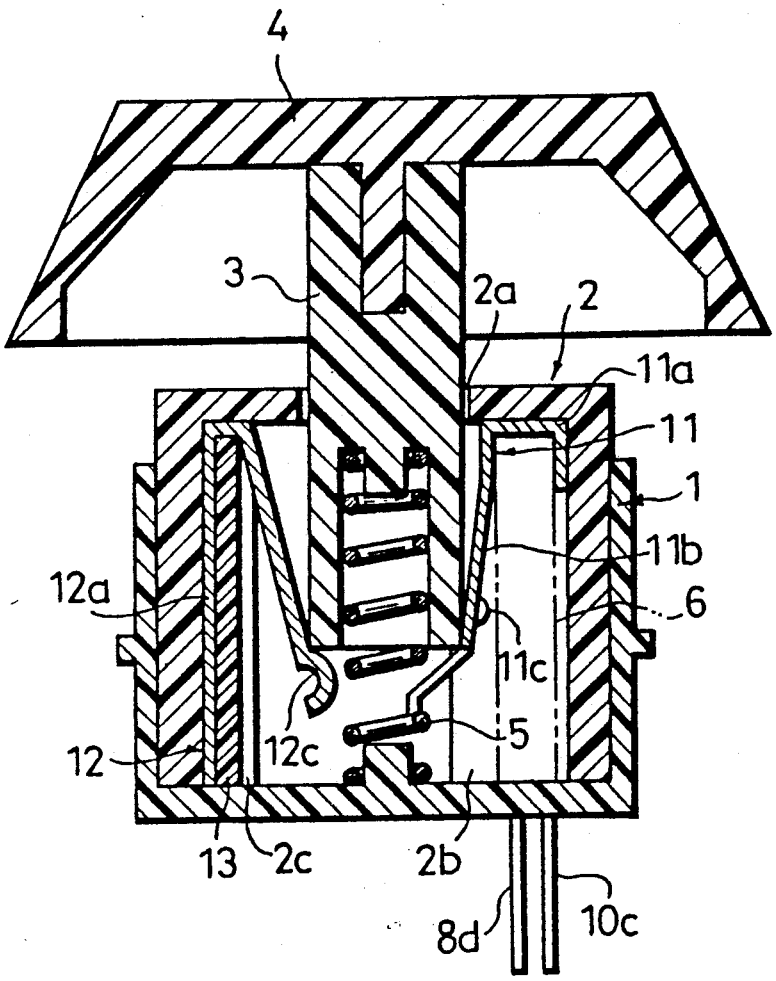
Fig. 2 PRIOR ART
FIG. 2 is a vertical sectional view of the push button switch in the prior art.
Figure 3:
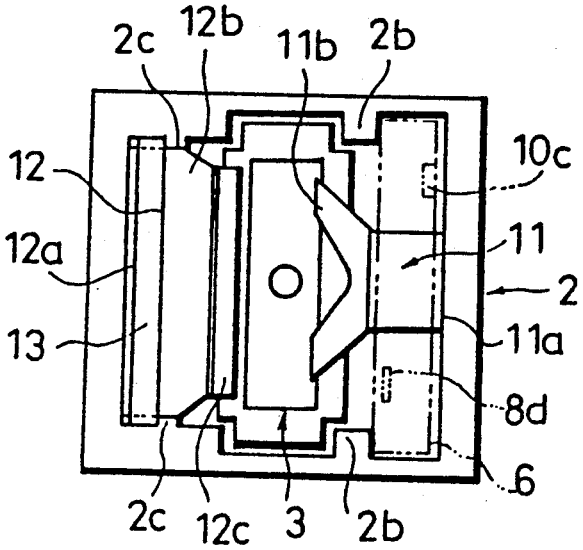
Fig. 3 PRIOR ART
FIG. 3 is a bottom plan view of the push button switch shown in FIG. 2 with the lower case removed.
Figure 4:
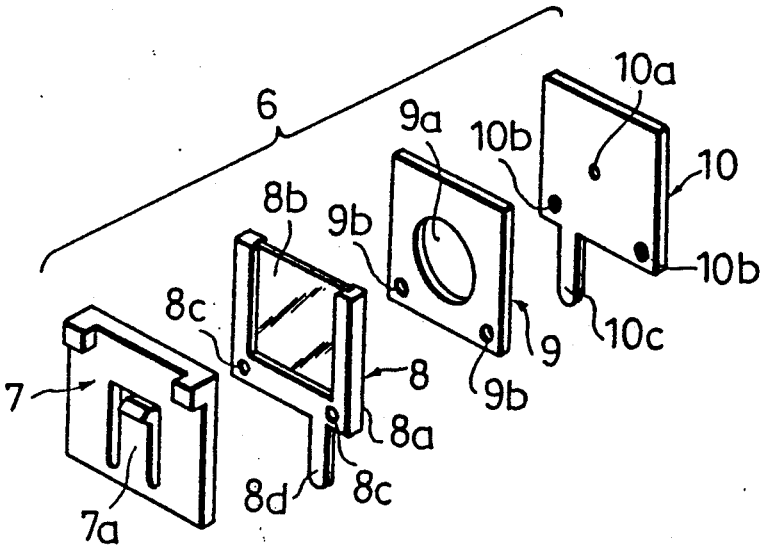
Fig. 4 PRIOR ART
FIG. 4 is an exploded perspective view of the switch element to be installed in the push button switch shown in FIG. 2.

Referring to FIG. 1, the same or corresponding parts as to FIGS. 2 to 5 are designated by the same reference numerals. As shown in FIG. 1, the operating member 7 constituting a part of the switch element 6 is formed at its lower central position with a projection 15. Accordingly, there is defined a space A between the lower surface of the switch element 6 and the bottom inner surface of the lower case 1. The other components of the push button switch are similar to the construction of the prior art switch as mentioned above with reference to FIGS. 2 to 5, and the explanation thereof will be omitted hereinafter.

In mounting the push button switch of the present invention onto the printed circuit board 14, the terminals 8*d* and 10*c* of the switch element 6 projecting from the lower surface of the lower case 1 are inserted through holes of the printed circuit board 14. Then, the flux is applied to the soldering lands 14*a* of the printed circuit board 14 and the terminals 8*d* and 10*c* of the switch element 6. Then, the printed circuit board 14 is dipped into a solder bath to solder the terminals 8*a* and 10*c* to the soldering lands 14. In soldering, the flux is raised along the surfaces of the terminals 8*d* and 10*c* near to the bottom inner surface of the lower case 1. However, since there is defined the spaced A between the lower surface of the switch element 6 and the bottom inner surface of the lower case 1, there is no possibility that the flux will reach the switch element 6 by capillarity, thus preventing the imperfect electrical contact of the contact portions in the switch element.

Although the projection 15 is integrally formed with the operating member 7 of the switch element 6 in the above preferred embodiment as illustrated in FIG. 1, the projection 15' may be so formed as to project up from the bottom inner surface of the lower case 1, as illustrated in FIG. 6. In this case, the same effect may be obtained.

Further, although the projection 15 is located between both the terminals 8*d* and 10*c* in the above preferred embodiment, a pair of the projections 15'', 15'' may be provided between the terminal 8*d* and one inner side surface of the upper case 2 and between the terminal 10*c* and another inner side surface of the upper case 2, as shown in FIG. 7. In any case, it is only necessary to define the space for eliminating the capillarity between the lower case 1 and the switch element 6 by providing the projection or projections therebetween.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a switch having a case and a switch element having a lower surface, said switch element being a laminated structure comprising a fixed contact member, a moveable contact member, a spacer interposed therebetween and an operating member, each having a lower surface, said fixed contact member and said moveable contact member each having a terminal extending from its respective lower surface through an aperture which extends through said case, said terminals being provided for solder connection to a printed circuit board, the improvement comprising:

spacing means for providing a space between said lower surface of said switch element and an inner surface of the case at said apertures where said terminals extend through said case, wherein said spacing means is located at a central position between said terminals.

2. The switch as defined in claim 1, wherein said spacing means comprises a projection which is integral with said inner surface of said case and abutts said lower surface of said switch element.

3. In a switch having a case and a switch element having a lower surface, said switch element being a laminated structure comprising a fixed contact member, a moveable contact member, a spacer interposed therebetween and an operating member, each having a lower surface, said fixed contact member and said moveable contact member each having a terminal extending from its respective lower surface through an aperture which extends through said case, said terminals being provided for solder connection into a printed circuit board, the improvement comprising:

spacing means for providing a space between said lower surface of said switch element and an inner surface of the case at said apertures where said terminals extend through said case, wherein said spacing means comprises a pair of projection members, one of said pair of projection members being located between one of said terminals and a sidewall of said case, the other of said pair of projection members being located between the other of said terminals and another sidewall of said case.

4. The switch as defined in claim 3, wherein said projection members are integral with said inner surface of said case and abutt said lower surface of said switch element.

* * * * *